US005970667A

United States Patent [19]

Thaler

[11] Patent Number: 5,970,667

[45] Date of Patent: Oct. 26, 1999

[54] SPLIT FLASHING

[76] Inventor: Ken Thaler, 32-33 Maple Wood Drive, R.R. # 1, Parry Sound, Ontario, Canada, P2A

[21] Appl. No.: 08/798,617

[22] Filed: Feb. 11, 1997

Related U.S. Application Data

[63] Continuation-in-part of application No. 08/691,524, Aug. 2, 1996, abandoned.

[51] Int. Cl.[6] ..... E04D 13/14

[52] U.S. Cl. ..... 52/219; 52/60; 52/199; 285/42

[58] Field of Search ..... 52/219, 60, 199, 52/302.6, 584.1, 588.1, 582.1, 465, 462, 463, 464, 58, 59, 62; 285/42, 43

[56] References Cited

U.S. PATENT DOCUMENTS

| | | |
|---|---|---|
| 280,085 | 6/1883 | Sage . |
| 426,627 | 4/1890 | Sagendorph . |
| 737,437 | 8/1903 | Meyer . |
| 791,068 | 5/1905 | Baker . |
| 969,476 | 9/1910 | Holt . |
| 1,072,199 | 9/1913 | Wood . |
| 2,231,065 | 2/1941 | Gabel . |
| 2,582,723 | 1/1952 | Stemmons et al. . |
| 3,267,626 | 8/1966 | Daly . |
| 3,363,369 | 1/1968 | Miller . |
| 3,508,368 | 4/1970 | Tischuk et al. . |
| 4,366,656 | 1/1983 | Simpson . |
| 4,937,991 | 7/1990 | Orth . |
| 5,025,604 | 6/1991 | Yeamans . |
| 5,038,543 | 8/1991 | Neyer . |
| 5,176,408 | 1/1993 | Pedersen . |
| 5,392,576 | 2/1995 | Yeamans . |

*Primary Examiner*—Robert Canfield
*Attorney, Agent, or Firm*—Mark Kusner

[57] ABSTRACT

The invention provides a quickly installed and preferably reusable flashing unit for use in roofing or cladding of a building. The flashing is constructed of stainless steel sheet metal for superior corrosion resistance and to withstand rough handling as old roofing material is scraped off the flashing surfaces to prepare it for reuse. The flashing is assembled along joints between assembled flashing components. Each joint includes a resilient gasket between opposing edges of adjacent flashing components. Clips join the components together and resiliently compress the gasket between opposing edges of the adjacent components. After assembly around stacks, openings, edges or other roofing discontinuities, the flashing is incorporated into the roofing in a conventional manner. The invention provides, in its broad aspect, a novel flashing unit for weatherproofing a discontinuity in an external weatherproof membrane, said flashing being assembled along at least one joint, a portion of said joint being covered by said membrane, said flashing comprising: first and second components, each component having an opposing edge disposed at a distance from the opposing edge of the other component, thus defining said joint; gasket means, abutting each said edge, for resiliently sealing said joint; and clamp means, for joining said components and for sealingly compressing said gasket between said opposing edges. Three variations of the gasket and clamp means are described herein.

16 Claims, 9 Drawing Sheets

SPLIT FLASHING

REFERENCE TO RELATED APPLICATION

This application is a continuation-in-part of U.S. application Ser. No. 08/691,524 filed Aug. 2, 1996, now abandoned.

TECHNICAL FIELD

The invention is directed to a rapidly installed, and preferably reusable, flashing unit which provides a weatherproof seal utilizing resilient gaskets sealingly engaged between flashing components with clips.

BACKGROUND OF THE ART

Flashing is used throughout building construction to weatherproof roofing and other external building cladding membranes around discontinuities such as roof edges, juncture points with walls, around roof penetrations, such as pipes, supports for roof mounted equipment, and stacks which project through the roof.

Conventional flashing is constructed of thin sheet metal which is cut and assembled on site, or may be prefabricated for quick assembly on site. Typically, sheet metal flashing is assembled from components on the building site by spot welding, with snap lock joints, or with self-tapping screws. To complete the required weather seal, the flashing is soldered along exposed joints or sealed with caulking. A cap or counterflashing is assembled to around seal the penetrations at the top of the flashing.

The safe and proper installation of roofing, and other building weatherproofing membranes such as sheet metal external cladding, require favourable weather conditions. The high elevation and exposure to wind make safety a major concern. Wet weather makes surfaces slippery rendering such operations unsafe, introduces undesirable moisture into insulation etc., and impedes the proper bonding of adhesives and bitumen. Cold weather, snow or ice also make operations unsafe, and impractical in many cases. Strong winds lift roofing materials during installation and create safety hazards for workers. In general it is preferable to conduct operations in daylight. Accordingly, there are a limited number of months and limited days of those months where roofing or cladding operations may be carried out economically and safely, especially in northern climates.

As a consequence, the minimization of on site labour is a highly significant factor to achieve rapid installation during favourable weather conditions. Conventional methods of reducing on site labour include the prefabrication of standardized roofing and flashing components. The prefabricated flashing components can then be rapidly assembled on site, saving time and money.

Examples of such prefabricated roof flashing are described in the following prior art. U.S. Pat. No. 4,937,991 to Orth describes a stainless steel sheet metal split flashing that is prefabricated to fit around a pipe extending through a roof. The opposing edges of the prefabricated split flashing are quickly snap locked and lap spliced together on site. However, to complete the weatherproof sealing of the flashing it is necessary to solder the seams together in a conventional manner.

U.S. Pat. No. 280,085 to Sage describes a prefabricated split sheet metal flashing joined together along joints with C-shaped sliding sheet metal clips coacting with bent metal ridges on joint edges of the prefabricated flashing components. Again the only revealed means to seal such flashing is conventional soldering of the joints after assembly, or caulking. U.S. Pat. No. 1,072,199 to Wood and U.S. Pat. No. 3,368,369 to Miller describe similar prefabricated metal flashing assemblies with various interlocking joint features, but utilizing the conventional means of weatherproofing the joints.

A significant disadvantage of using conventional prefabricated flashing is that despite the elimination of on site cutting and fitting, the flashing is still sealed in a labour intensive manner, namely with soldering or caulking. Therefore, when favourable weather allows installation, the amount of labour required to complete the sealing necessary for a weatherproof installation of the flashing remains significant. As well, the level of skill remains high since skilled workers are relied upon to produce a critically important weatherproof seal in the flashing. If the soldering or caulking work is not of consistently high quality, leakage will occur resulting in costly repairs and reworking.

An additional disadvantage in use of conventional metal roof flashing is experienced during roofing repairs or complete reroofing. Conventional metal flashing is typically discarded during reroofing operations since the thin sheet metal is cut and distorted to remove it from the old roof. Although reuse and recycling are becoming more important, the best that can be done with conventional metal flashing after removal is to separate the different metals, such as copper, aluminium, galvanized or stainless steel, and sell them as scrap metal. If the volume of metal is not significant, even such recycling can be uneconomical and impractical. As a result, the old metal flashing is often simply removed and discarded during reroofing. New metal flashing is then installed with the new roof.

A typical flat roof for industrial or commercial buildings lasts about 10 to 15 years before leakage occurs and repairs increase to the point where complete replacement is the most economical solution. In contrast, most building components, and particularly sheet metal components, can have a much longer economical life of fifty or one hundred years if properly maintained. Roofing is also replaced in order to better insulate older buildings by installing rigid insulation on roof decks.

In the life span of a typical industrial or commercial building then, the periodic replacement of a roof, and in particular the removal and replacement of metal flashing can be a significant expense in building maintenance.

Prior to the present invention, reroofing has involved disposal of relatively expensive metal flashing and complete replacement. Since corrosion resistant metal is used such as cooper, aluminium, galvanized or stainless steel, the old metal flashing used is often in good serviceable condition when the bituminous roofing material has deteriorated. The soldering of conventional thin sheet metal flashing and coating with bitumen etc. during roofing makes it necessary to sacrifice metal flashing of good quality in order to replace the rest of the roof which has deteriorated. The waste of uncorroded material and cost of replacing flashing is substantial.

It will be understood that although this description of prior art and the invention is focused on use in built up bitumen roofing construction, the same considerations and scope of the invention relate to any waterproof membrane such as sheet metal wall cladding, or aluminium siding which also use sheet metal flashing assemblies. It will also be understood that the prior art and invention are not restricted to sheet metal flashing but also include spun or extruded aluminium, or molded plastic flashing.

It is desirable therefore to produce a prefabricated flashing which is quickly assembled and facilitates rapid completion of the weatherproof seal, while providing high reliability.

It is also desirable to produce metal flashing that can be reused in order to reduce costs during reroofing operations and to reduce the waste involved.

DISCLOSURE OF THE INVENTION

The invention addresses the disadvantages of the prior art by providing a prefabricated flashing unit which is extremely simple and quick to install, requires no tools or special skill to produce a permanent weatherproof seal, and is preferably reusable. During reroofing, the flashing can be disassembled, cleaned and then reused in the replacement roofing resulting in cost and labour savings.

The flashing is preferably constructed of stainless steel sheet metal for superior corrosion resistance, however, aluminium or copper may also be used depending on the job requirements. Depending upon the particular application various thicknesses of sheet metal can be used. Thin sheet metal is preferred to reduce costs, however, in some cases a relatively thick sheet gauge may be preferred to prevent welding heat distortion during prefabrication, and to withstand rough handling as old roofing material is scraped off the flashing surfaces to prepare it for reuse. Stainless steel reusable sheet metal flashing will resist corrosion and have an extended service life many times that of the other roofing materials such as bituminous material which requires periodic replacement or major repair every 10 to 15 years.

The flashing is assembled along joints between assembled flashing components. Each joint includes a resilient gasket between opposing edges of adjacent flashing components. Clamps join the components together and resiliently engage the gasket with each opposing edge of the adjacent flashing components. Preferably the clamps arc releaseable clips disposed inwardly of the flashing keeping them clear of adhesive roofing materials such as bitumen for easy removal. After assembly around stacks, openings; edges or other roofing discontinuities, the flashing is incorporated into the roofing in a conventional manner.

On site assembly labour and skill level is reduced in comparison to conventional methods since on site soldering or caulking is not required. The level of skill required to assemble a prefabricated flashing with a gasket and clips is much less than that required to properly waterproof conventional flashing with solder or caulk, and takes less time.

An advantage of using the flashing invention herein relates to the ability to reuse flashing components, gaskets and caps during repairs or reroofing. The flashing can be disassembled easily by releasing spring loaded resilient clips or completely removing sliding clips with pliers, removing the flashing components from engagement with the resilient gasket and cleaning the components. Conventional flashing cannot be reused and is simply discarded. The cost and labour involved in replacing flashing is substantially reduced through such reuse.

The invention provides, in its broad aspect, a novel flashing unit for weatherproofing a discontinuity in an external weatherproof membrane, said flashing being assembled along at least one joint, a portion of said joint being covered by said membrane, said flashing comprising: first and second components, each component having an opposing edge disposed at a distance from the opposing edge of the other component, thus defining said joint; gasket means, abutting each said edge, for resiliently sealing said joint; and clamp means, for joining said components and for sealingly engaging said gasket with each said opposing edge.

Three variations of the gasket and clamp means are described herein. A first variation comprises a sheet metal assembly wherein: each edge includes a lip having a lip profile; an abutting portion of the gasket means has a complementary mating gasket profile; the ridges and lip comprise a reverse bend along said opposing edges; and wherein the clip means comprise a C-shaped sheet metal cleat.

A second variation comprises a sheet metal assembly wherein one opposing edge includes a projecting tongue and the other opposing edge includes a bifurcated gasket within a reverse bend open housing, the bifurcated gasket having two arms each engaging said tongue. The gasket arms are tapered away from said housing. The clamp means comprise a bent ridge projection on a rearward portion of said tongue and spring loaded hook extending forwardly from said housing.

A third variation provides a clip with a projecting tab having an abutment surface parallel to the joint, with detent means for engaging the abutment surface of the tab.

The flashing has one opposing edge including a projecting tongue and the other opposing edge including a reverse bend open housing with the gasket disposed between and engaging the tongue and housing.

Further details of the invention and its advantages will be apparent from the detailed description and drawings included below.

BRIEF DESCRIPTION OF THE DRAWINGS

In order that the invention may be readily understood, a preferred embodiment of the invention, and a variation thereof, will be described by way of example, with reference to the accompanying drawings wherein.

DETAILED DESCRIPTION OF PREFERRED EMBODIMENT

Figure 1:
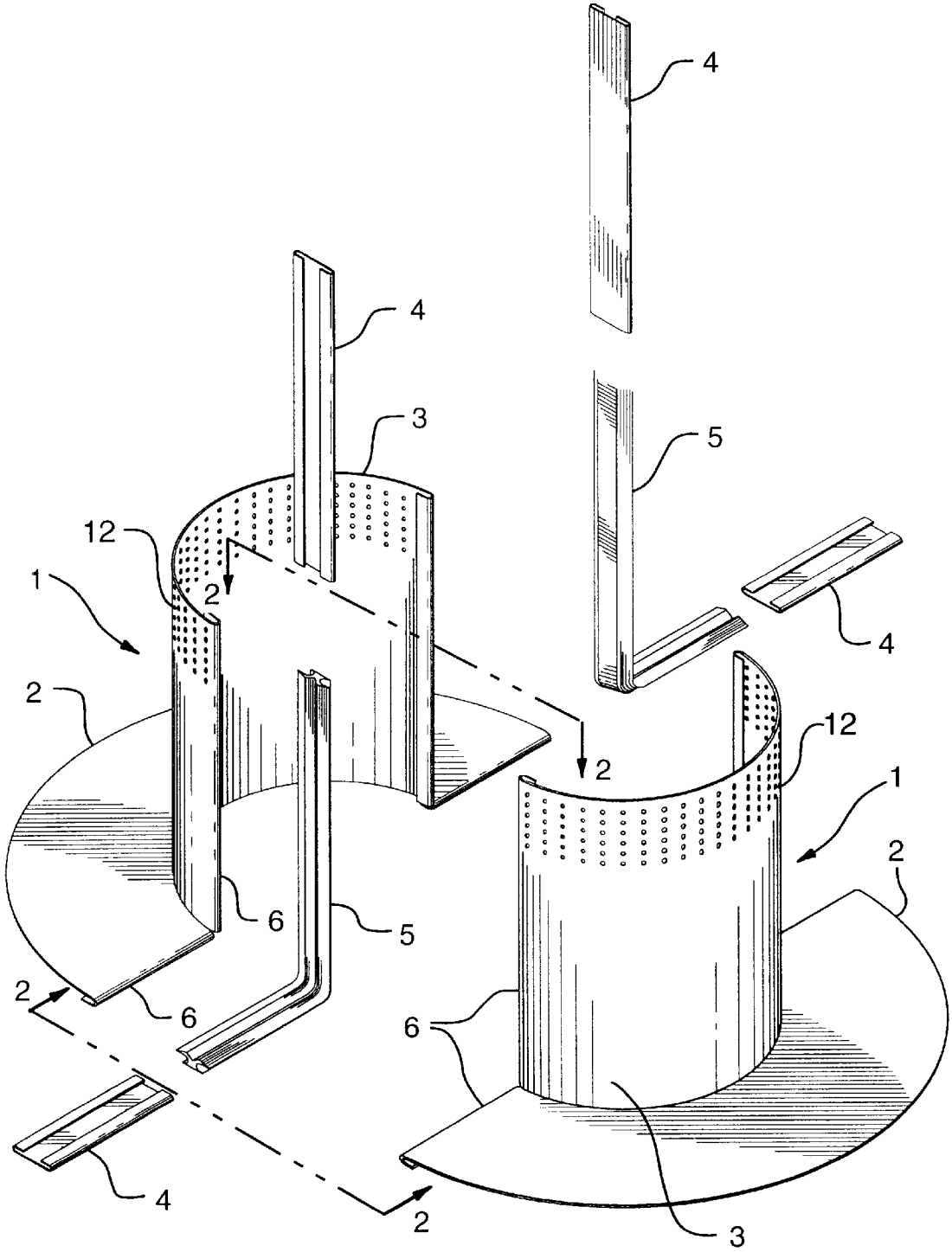
FIG. 1 is an exploded perspective view of one embodiment of the invention, with a first variation on the gasket and clamp means design, showing a typical split cylindrical flashing, with identical opposing half components, rubber gaskets and removable sliding cleats, for waterproofing around a pipe or stack extending through a roof membrane.
Figure 4:
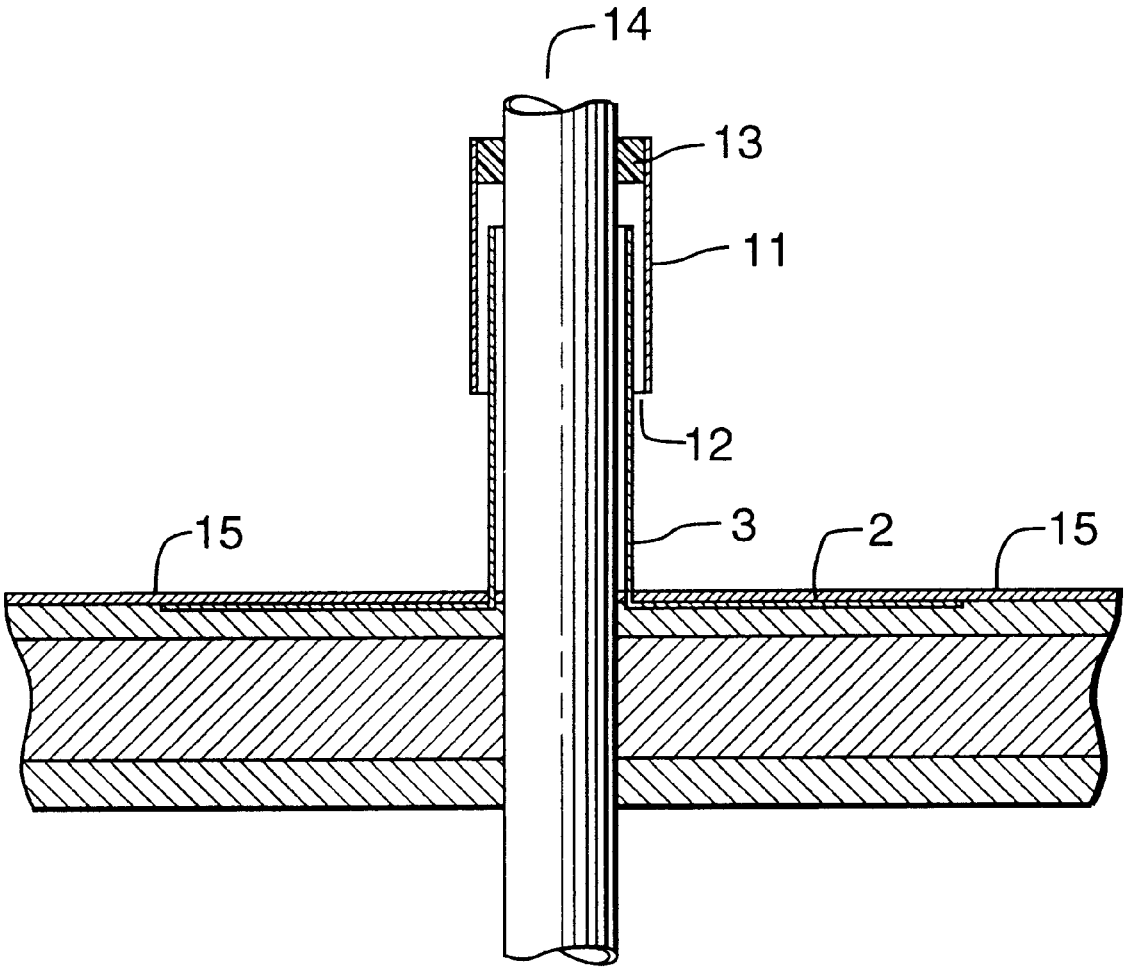
FIG. 4 is a vertical sectional view of the flashing installed around a pipe extending through a roof structure covered with rigid insulation and built up roofing layers overlapping the flashing base.
Figure 5:
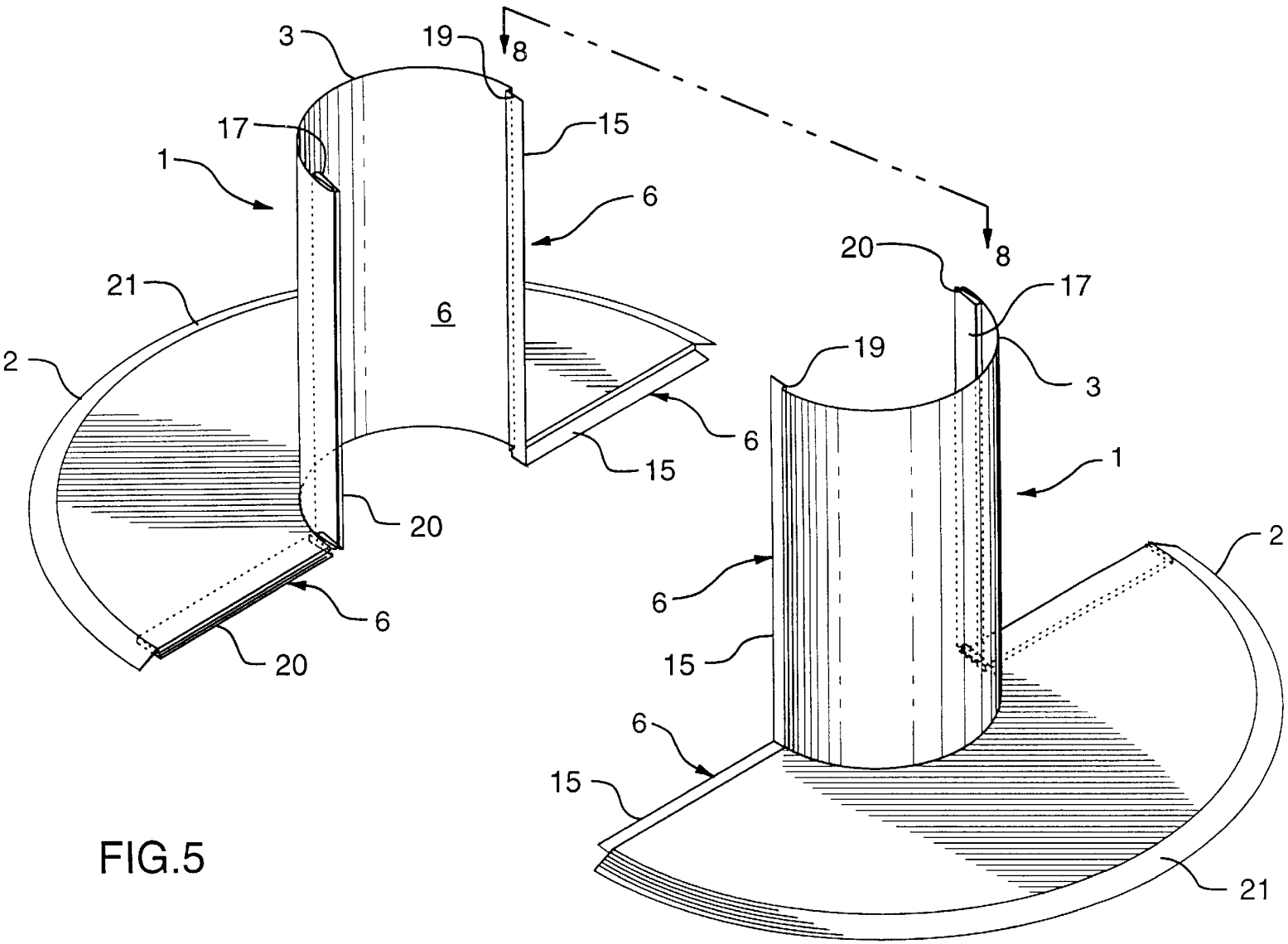
FIG. 5 is an exploded perspective view of a second embodiment of the invention, with a second variation on the gasket and clamp means design, otherwise similar to the view of FIG. 1.
Figure 6:
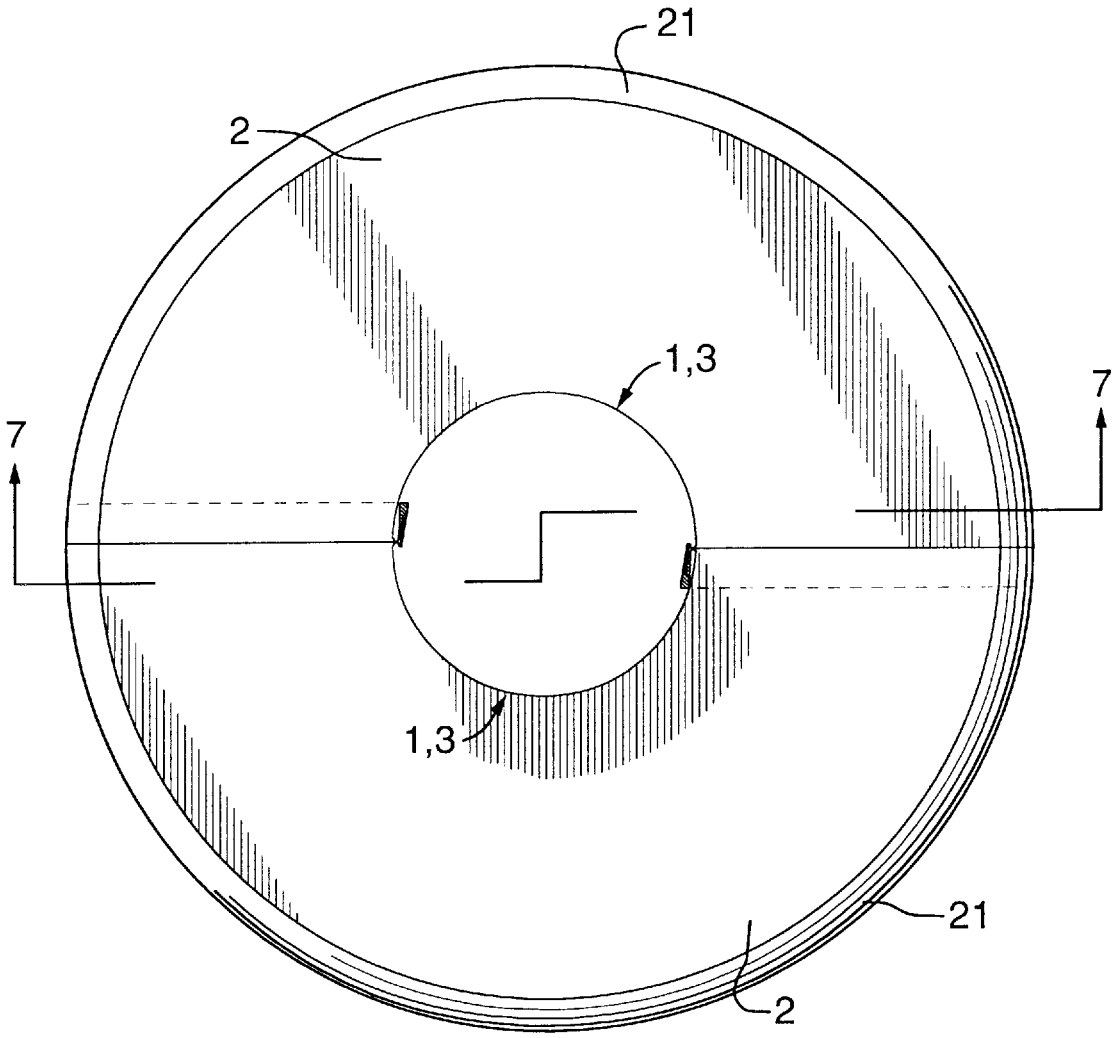
FIG. 6 is a plan view of an assembled flashing as shown in FIG. 5.
Figure 7:
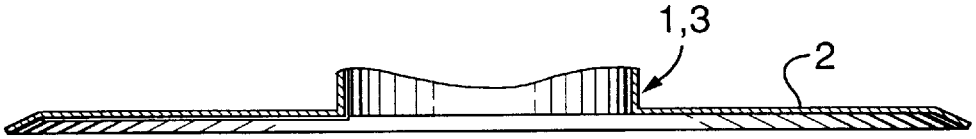
FIG. 7 is a sectional view along line 7—7 of FIG. 6.

With reference to FIGS. 1 and 5, it will be readily understood that various shapes of flashing can be built up using the invention disclosed herein. For example, cylindrical or rectangular flashing, flat or angular flashing or complex shapes may be fabricated as reusable flashing but in the wide variety common to conventional sheet metal flashing. In addition, flashing in accordance with the invention may include numerous releasable joints depending on the design and shape. The first and second embodiments of FIGS. 1–8 relate to the examples of a simple cylindrical split flashing with two releasable joints, whereas the third embodiment of FIGS. 9–13 includes seams with gasket seals between other parts of the built up flashing and cap.

Any roofing discontinuity, or discontinuity in other weatherproof membranes such as sheet metal siding, can be weatherproofed with flashing in accordance with the invention to replace conventional flashing. The flashing is releasably separable along at least one joint, and fabrications including any number of joints or components are possible.

A first embodiment of the invention is described herein with reference to FIGS. 1 and 4, the example of reusable flashing shown includes first and second identical mating half components 1 for encircling the bottom portion of a pipe 14 discontinuity piercing through a roofing membrane 15. The halves 1 include a half annular base 2 welded to a projecting half cylindrical stack 3. Each half component 1 has an opposing edge 6 disposed at a distance from the opposing edge of the other component 1, thus defining a joint along a vertical plane through which the flashing assembly is split.

As in conventional flashing of the type illustrated, the base 2 is used in overlapping engagement with roofing membranes and the projecting stack 3 extends outwardly from the base 2 for cladding the lower portion of the roofing opening or other discontinuity, such as the pipe 14 shown in FIG. 4. The projecting portion may take the form of a half cylinder, half rectangle or any other conventional flashing shape, including flat sheets or angles.

A releasable gasket 5 abuts each edge 6 bridging between the half components 1 and resiliently sealing the joint. Releasable clamps 4 join the components 1 together and sealingly compress the gasket between the opposing edges 6.

Figure 2:
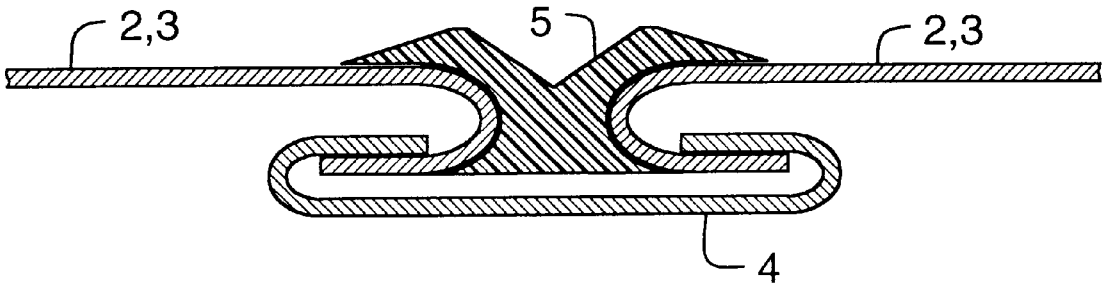
FIG. 2 is a sectional view through a typical vertical or horizontal assembled joint along lines 2—2 of FIG. 1.

FIG. 2 shows the detail of the assembled gasket 5 with slideable sheet metal cleat 4 installed. The same detail is applied to the joint between the base 2 and the stack 3. Molded rubber gaskets 5 are formed to conform to the finished shape of the joint and provide a complete waterproof seal when compressed between the edges 6 of the half components 1. The gasket 5 is continuous with a constant cross section having a base gasket portion which merges with the projecting stack portion to abut and seal the opposing edges 6 of the base 2 and stack 3 respectively. If the radius of bend in the flashing is relatively large, it is possible to achieve a waterproof seal with an extruded rubber gasket flexibly bending to mate the bend of the flashing. Any conventionally used gasket material can be adapted for use in the invention, including resilient elastomeric materials, silicone, or rubber.

Figure 3:
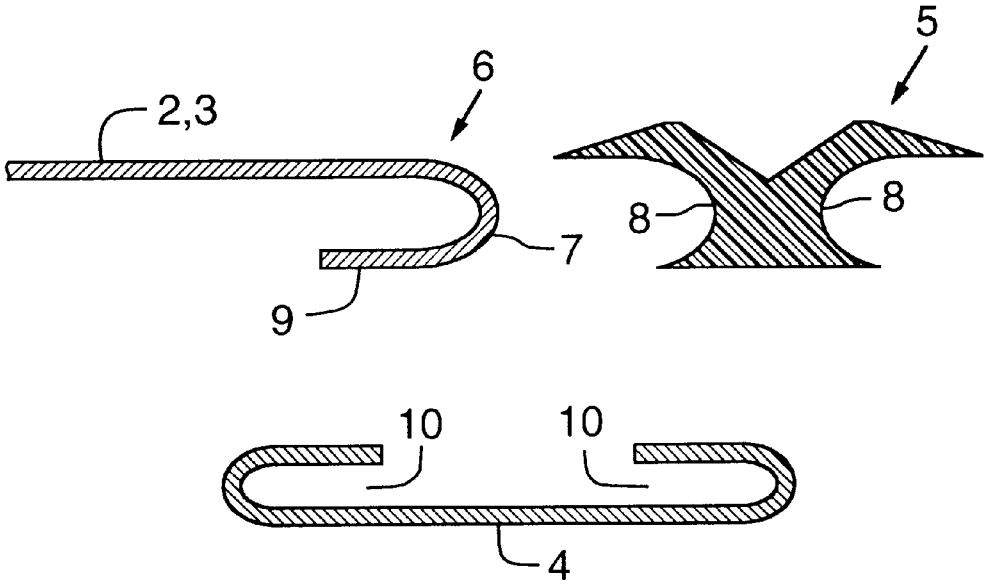
FIG. 3 is an exploded detail similar to FIG. 2 showing the reverse bent edge and mating profile of the gasket.

In the first embodiment illustrated in FIGS. 1–4, the edge 6 is formed by reverse bending the sheet metal of the base 2 and stack 3 inwardly. As best shown in FIG. 3, each edge 6 includes a lip 7 with a selected lip profile. The lip profile shown is a simple bent radius, however, depending upon the design and sealing properties desired, different lip profiles or multiple bends for multiple gaskets are within the scope of the invention. The abutting portion of the gasket 5 has a complementary mating gasket profile 8.

To clamp the components 1 together and seal the joint by compressing the gasket 5, sheet metal cleats 4 are provided. The means to clamp the components together include projections 9, in the illustrated form of a bent sheet ridge 9, adjacent each edge 6 and parallel to the joint. The cleats 4 are slideable and releasably engage each projecting ridge 9 spanning across the joint. The cleat 4 is a C-shaped sheet metal assembly with inward longitudinal grooves 10 which slidably engage each ridge 9.

To keep the cleats 4 clear of adhesives and bitumen, the ridges 9 and cleats 4 are disposed inwardly of the weatherproof roofing membrane. Of course, the ridges 9 and cleats 4 could be disposed outwardly if desired however cleaning and removal for reuse would be more difficult.

To remove the cleats 4 and disassemble the flashing, one need merely grasp the outer portion of the cleat 4 with pliers and slide it off the ridges 9. Since the interior of the flashing is free of adhesives and bitumen cleats will slide off easily. The gasket 5 can then be removed and the entire assembly split along the joint. The gasket 5 ensures that the edge 6 and lip 7 remain clean. Once the old roofing material has been scraped off the thick gauge stainless steel half components 1, the flashing is ready for reuse in the new roof. The metal components 1 may be heated with a torch to facilitate removal of bitumen etc., and if necessary the gasket 5 can be replaced if it is damaged or has deteriorated.

As shown in FIG. 4, the flashing includes a removable split cap 11, with annular cap gasket 13 which shields the upper portion of the flashing from the weather. To allow escape of moisture and warm air leaking from improper seals in the roofing, air vent holes 12 are provided in the stack 3 and underside of the cap 1.

As described above, the reusable flashing is easily assembled on site with releasable cleats 4. There is no need to solder joints since the compressed gasket 5 completes a long lasting weatherproof seal. As a result on site labour is reduced and the speed of installation of flashing is increased substantially.

The weatherproof seal using a gasket 5 can be completed in wet or cold weather, or poor lighting unlike soldering which requires relatively dry weather. The installation of the gasket 5 does not require skilled labour. The operation is simple enough to be properly completed and inspected by relatively unskilled workers.

The expense and time scheduled for reroofing or repair operations is significantly reduced since all parts of the flashing can be reused as described above. The thick non-corrosive metal flashing is easily removed from the old roof and cleaned for reuse. Scrap and waste are reduced, and the cost associated with fabricating and delivering new flashing is eliminated. When relatively thin sheet metal is used, of course more care must be taken to avoid damage to the reusable flashing when removing from the old roof and scraping to remove bitumen etc., however the savings in cost in the initial use of thinner sheet metal can offset the extra labour involved during reuse.

A second embodiment of the invention is described with reference to FIGS. 5–8, the significance of which is in the edges 6, different bifurcated gasket 16 and clamp means.

The drawings of FIGS. 5–8 show use of a relatively thin sheet metal which has resilience or spring when bent. This spring feature is used to advantage in providing a spring loaded hook 20 as part of the clamp means. The outer edge 21 of the base 2 is tapered to strengthen the thin sheet metal base edge 21 compensating for the tendency of thin metal to buckle at the base edge 21, and reinforcing the base edge 21 against accidental bending.

However, it will be understood that the flashing remains essentially the same as that described above in reference to the first embodiment. The advantages of easy assembly with minimal labour and skill, with no special tools or skills required to achieve a weatherproof seal, and the option of reusability remain in both embodiments.

With reference to FIGS. 5–8, the embodiment shown includes a projecting tongue 15 on one opposing edge 6. The other opposing edge includes a bifurcated gasket 16 within a reverse bent open housing 17. The bifurcated gasket 16 has two arms 18 each of which engage an opposite side of the sheet metal tongue 15. The enveloping of the tongue 15 with the bifurcated gasket 16 provides a complete waterproof seal which is simple to assemble especially where the arms 18 of the gasket 16 are tapered away from the housing 17 to provide a surface to guide the tongue into proper positioning within the gasket 16.

Figure 8:
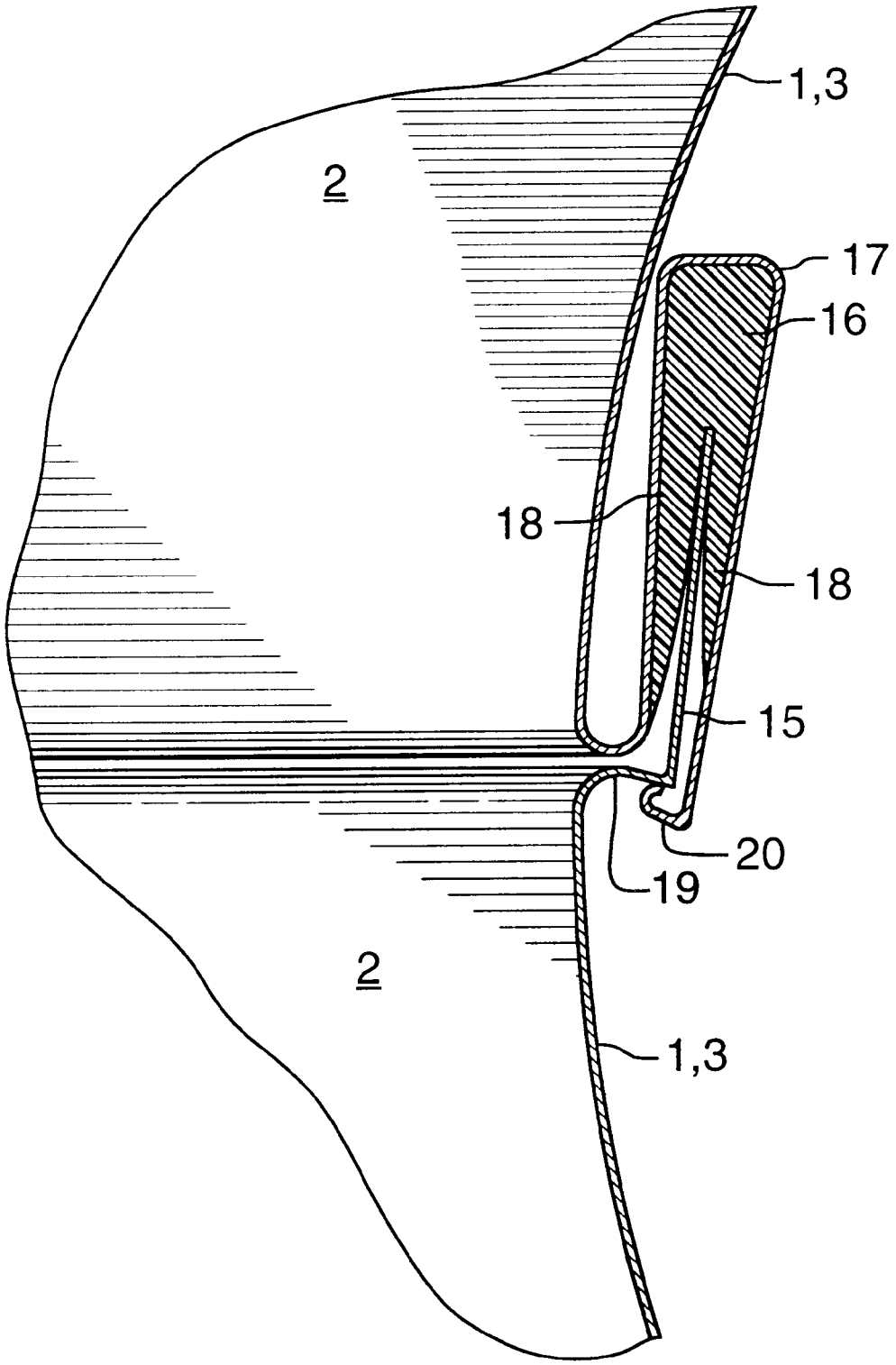
FIG. 8 is a sectional view through a joint showing the assembled tongue engaging the bifurcated gasket in the U-shaped housing, and the engagement of the spring loaded hook with bent ridge projection rearward of the tongue, typical of that indicated by lines 8—8 of FIG. 5.
Figure 9:
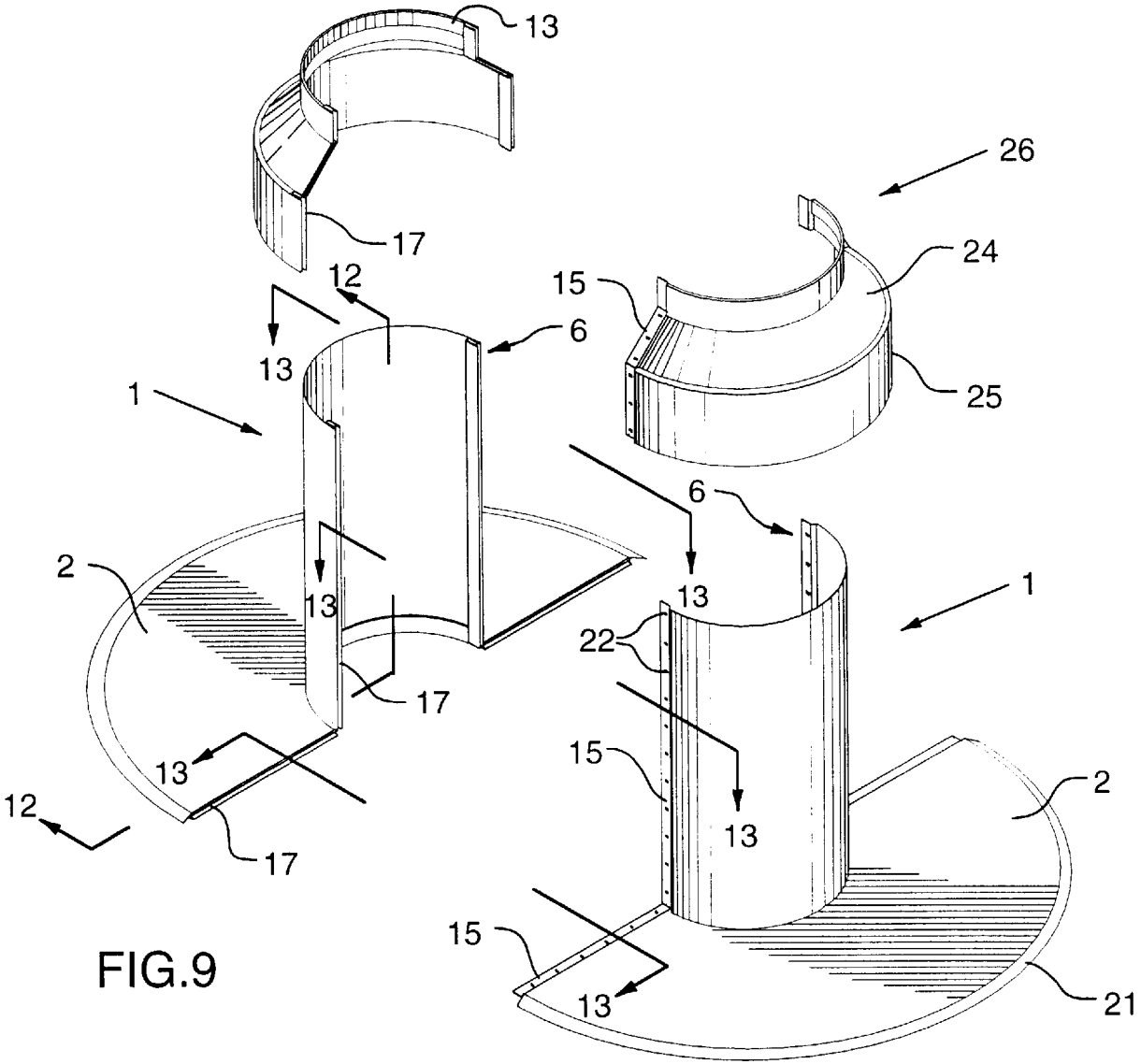
FIG. 9 is an exploded perspective view of a third embodiment of the invention, with a third variation on the gasket and clamp means design, and also showing a split cap assembled along a like seam with gasket and clamp means.

The clamp means in respect of the second embodiment take advantage of the resilience of flat portions, and stiffness of bent portions of fabrications made of thin sheet metal. As best illustrated in FIG. 8, on a rearward portion of the tongue 15, a projecting ridge 19 is formed by bending the thin sheet metal of one component. A spring loaded hook 20 is formed by bending a forward extension of the sheet metal housing 17.

As will be appreciated, the insertion of the tongue 15 a sufficient distance into the bifurcated gasket 16 brings the hook 20 into spring loaded engagement with the projecting ridge 19. To release the hook 20 during reuse for example, it is only necessary to pry the hook 20 inwardly a short distance with a flat head screwdriver or with ones fingers.

A third embodiment of the invention is described with reference to FIGS. 9–13. The significant differences relate to the vertical edges 6, simple wedge gasket 21, and clamp means which utilize tabs 22 and a spring loaded detent hook 23. Also featured are horizontal seams between the base 2 and stack 1 which include a gasket 21, and between the top portion 24 and the skirt 25 of the split cap 26.

With reference to FIGS. 9–13, the third embodiment shown includes projecting tabs 22 with an abutment surface parallel to the joint or seam. The detent hooks 23 provide means to engage the abutment surfaces of the tabs 22 in a snap locking fashion. The tabs 22 and detent hook 23 are preferably disposed inwardly of the weatherproof membrane as illustrated.

Similar to the second embodiment, the third embodiment includes a projecting tongue 15 on one opposing edge 6. The other opposing edge 6 includes a reverse bend open housing 17. The gasket 23 is disposed between and sealingly engages the tongue 15 and housing 17 as best shown in the assembled joint and seam of FIGS. 12–13. Tabs 22 are provided on a rearward portion of the tongue 15 for interlocking with the spring loaded hook 23 extending forwardly from the housing 17.

Figure 10:
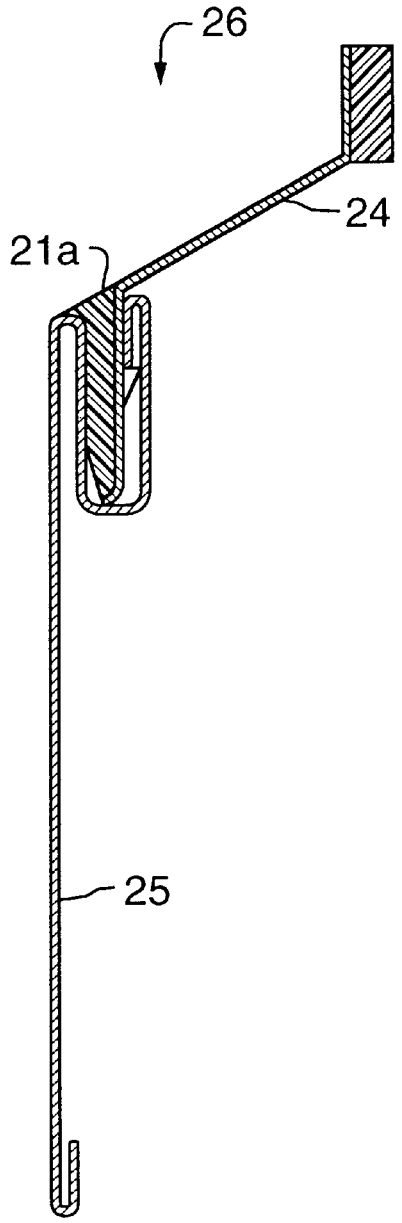
FIG. 10 is a sectional view through the split cap along line 10—10 of FIG. 9.
Figure 11:
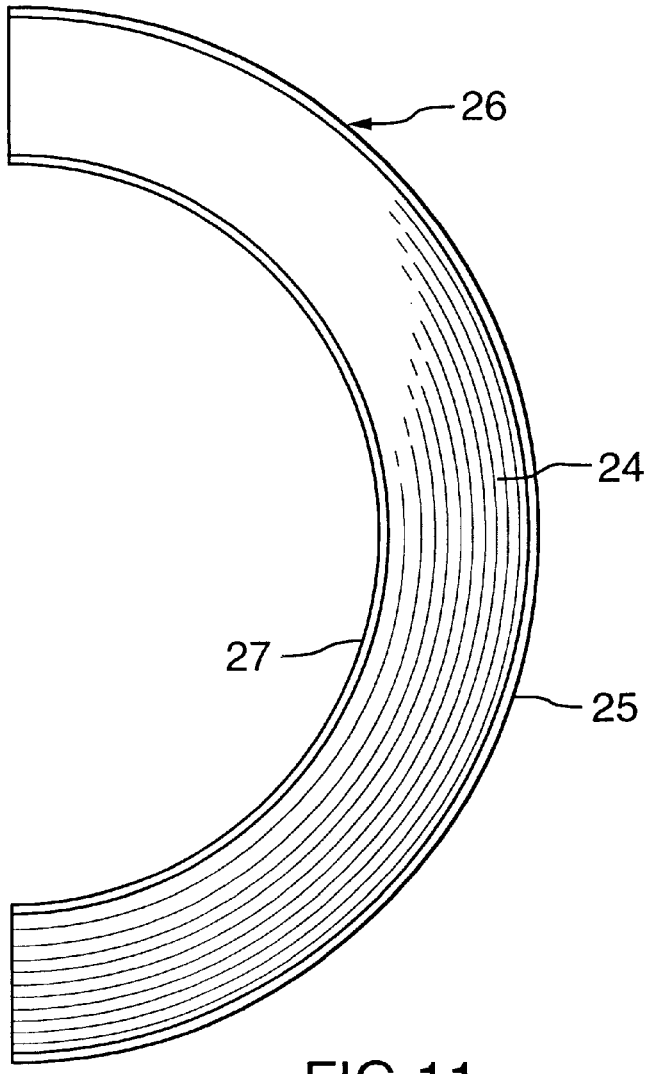
FIG. 11 is a plan view of one half of the split cap.
Figure 12:
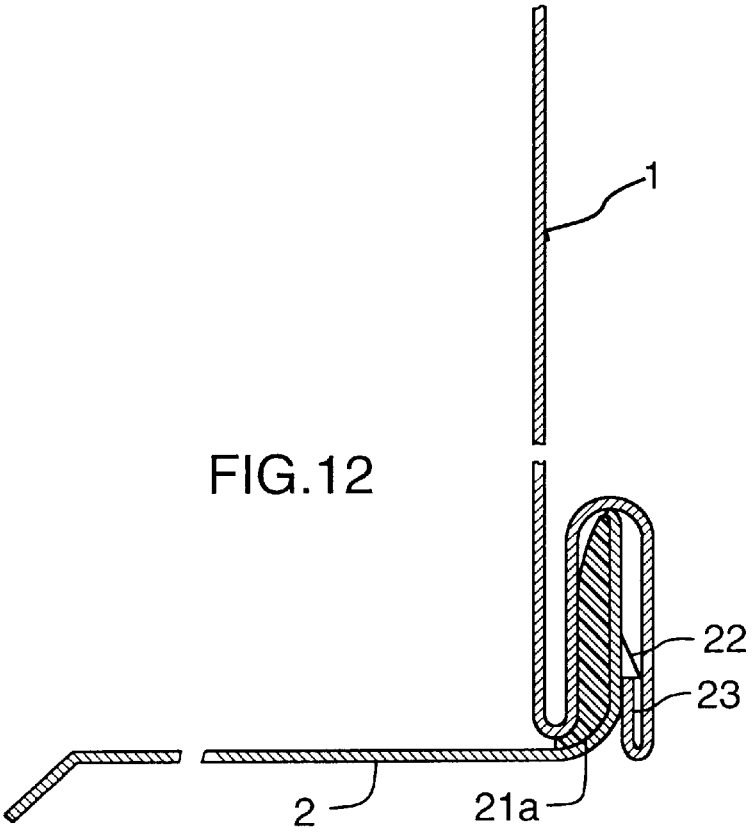
FIG. 12 is a sectional view through the assembled seam between the base and stack, along line 12—12 of FIG. 9.
Figure 13:
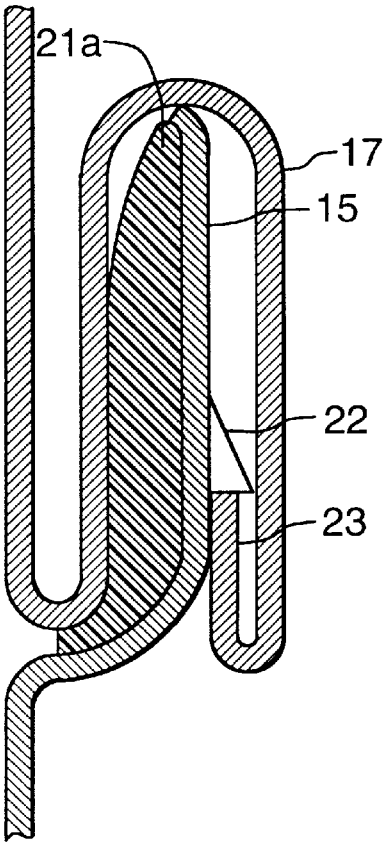
FIG. 13 is a typical sectional detail view of an assembled joint along line 13—13 of FIG. 9.

In order to eliminate soldering and speed up assembly, the third embodiment includes a similar arrangement of snap locking seam between the base 2 and the stack 1 as best shown in FIG. 12. A similar snap locking seam is provided between the top portion 24 of the split cap 26 and the skirt portion 25 of the cap 26 as best shown in FIG. 10. A top seal gasket 13 is provided to seal the flashing cap to the pipe or other building component.

As a result of providing such seams, the parts of the flashing can be manufactured, stocked, and shipped separately to be snap locked together on site. By separating the base 2 and stack 1, and the top portion 24 and skirt portion 25 of the cap 26, these modular parts can be provided from standard inventory and assembled to suit a variety of different height of stack 1, length of skirt 25, size of opening in the top cap 24 as desired. A stock of modular parts can provide for a variety of configurations flexibly eliminating some of the need for custom manufacture.

Although the above description and accompanying drawings relate to a specific preferred embodiment as presently contemplated by the inventor, it will be understood that the invention in its broad aspect includes mechanical and functional equivalents of the elements described and illustrated.

I claim:

1. A flashing unit for weatherproofing a discontinuity in an external weatherproof membrane, said flashing unit being assembleable along at least one joint, said flashing unit comprising:

first and second components, each component having an opposing edge disposed at a distance from the opposing edge of the other component, thus defining said at least one joint:

gasket means for resiliently sealing said at least one joint, and clamp means, for joining said components and for sealingly engaging said gasket means with each said opposing edge, said clamp means comprising a projection adjacent at least one said edge and clip means spanning said at least one joint for engaging each said projection, each said projection comprising a ridge parallel to said at least one joint, and wherein said clip means include a longitudinal groove engaged on each said ridge, each ridge and clip means being disposed inwardly, the unit comprising a sheet metal assembly wherein one opposing edge includes a projecting tongue and the other opposing edge includes a bifurcated gasket within a reverse bend open housing, the bifurcated gasket having two arms each engaging said tongue.

2. A unit according to claim 1 wherein the gasket arms are tapered away from said housing.

3. A unit according to claim 1 wherein the clip means comprise a bent ridge projection on a rearward portion of said tongue.

4. A unit according to claim 3 wherein the clip means further comprise spring loaded hook extending forwardly from said housing.

5. A unit according to claim 4, wherein each component includes: base means for overlapping engagement with said membrane: and projecting means, extending outwardly from said base means, for cladding at least a portion of said discontinuity.

6. A unit according to claim 5, including a continuous gasket, having a base gasket portion merged with a projecting gasket portion, abutting the opposing edges of the base means and projecting means of each component respectively.

7. A unit according to claim 5, wherein each component comprises identical mating half portions.

8. A unit according to claim 7 wherein the projecting portion comprises a semicylindrical stack.

9. A unit according to claim 7 comprising removable cap means, for shielding an outward portion of said projecting means of each component from the weather.

10. A unit according to claim 9 wherein each said outward portion and said cap means include air vent holes.

11. A unit according to claim 1 wherein the components comprise stainless steel sheet material.

12. A unit according to claim 1 wherein the gasket means comprises a resilient elastomeric gasket.

13. A unit according to claim 12 wherein the gasket comprises a moulded rubber gasket.

14. A unit according to claim 12 wherein the gasket comprises an extruded rubber gasket.

15. A unit according to claim 1, wherein said projection comprises a tab with an abutment surface parallel to said at least one joint, and wherein said clip means include detent means for engaging the abutment surface of said tab.

16. A unit according to claim 15, wherein the tab and detent means are disposed inwardly.

* * * * *